US005686985A

United States Patent [19]

Hayashi

[11] Patent Number: 5,686,985

[45] Date of Patent: Nov. 11, 1997

[54] TONER CONTAINER AND DEVELOPING DEVICE WITH THE SAME TONER CONTAINER ASSEMBLED THEREIN

[75] Inventor: Yukihisa Hayashi, Mie, Japan

[73] Assignee: Kyocera Corporation, Kyoto, Japan

[21] Appl. No.: 471,259

[22] Filed: Jun. 6, 1995

[30] Foreign Application Priority Data

Aug. 31, 1994 [JP] Japan ..... 6-230238
Aug. 31, 1994 [JP] Japan ..... 6-230641

[51] Int. Cl.[6] ..... G03G 21/10

[52] U.S. Cl. ..... 355/260; 222/DIG. 1

[58] Field of Search ..... 355/260, 245; 222/DIG. 1

[56] References Cited

U.S. PATENT DOCUMENTS

| | | | |
|---|---|---|---|
| 4,993,829 | 2/1991 | Naganuma et al. | 355/245 X |
| 5,243,390 | 9/1993 | Takemoto et al. | 355/245 |
| 5,289,241 | 2/1994 | Sugiyama et al. | 355/260 |
| 5,309,211 | 5/1994 | Yoshioka | 355/260 X |

FOREIGN PATENT DOCUMENTS

| | | |
|---|---|---|
| 2-33168 | 2/1990 | Japan . |
| 6-11967 | 1/1994 | Japan . |
| 6-3887 | 1/1994 | Japan . |

*Primary Examiner*—Nestor R. Ramirez

*Attorney, Agent, or Firm*—Loeb & Loeb LLP

[57] ABSTRACT

The invention is applicable to a developing device with a toner hopper as toner container, which can be mounted and dismounted and includes a toner replenishment roller controlled for rotation according to a detection signal of a toner concentration sensor. A shutter capable of being rotated along the outer periphery of the toner replenishment roller, is provided for opening and closing an opening at predetermined angular positions. At least one shutter opening end is in frictional contact with roller periphery, thus permitting stable mounting and dismounting of the toner container with respect to a developer container in a simple operation.

Further, in a toner container comprising a replenishment toner accommodating section and a waste toner recovery section formed at a longitudinal end of the accommodating section via a partitioning wall, the volume ratio between the replenishment toner accommodating section and the waste toner recovery section is set such that no overflow of waste toner occurs. A toner accommodation space is formed by an inclined wall extending substantially downward from a toner replenishment roller mounting portion of the replenishment toner accommodating section such that replenishment toner in it can be pulled up onto the toner replenishment roller mounting portion with the rotation of a toner agitating fin. It is thus possible to provide a suitable layout structure of toner container having an integral waste toner recovery section for accommodating waste toner after toner image formation.

9 Claims, 4 Drawing Sheets

TONER CONTAINER AND DEVELOPING DEVICE WITH THE SAME TONER CONTAINER ASSEMBLED THEREIN

BACKGROUND OF THE INVENTION

Field of the Invention

This invention relates to toner containers and developing devices with the same toner containers assembled therein, these toner containers and developing devices being employed in image forming apparatus applied as facsimile sets, printers, copiers or composite machines having functions thereof for forming image by using powder toner.

Description of the Prior Art

Heretofore, as image forming apparatus applicable as facsimile sets, printers, copiers or composite machines having functions thereof, there have been well known electrophotographic apparatuses, electrostatic recording apparatuses or like indirect toner image recording systems, in which toner image is formed through development of electrostatic latent image written by exposure means on a photosensitive drum or a photosensitive belt and is transferred via the photosensitive drum or the photosensitive belt onto recording sheet. There are also well known direct toner image recording systems, in which toner image is formed directly onto recording sheet from by causing toner to fly out from a toner carrier roller through energization control of a matrix-like mesh electrode according to image information, the mesh electrode being disposed between the toner carrier roller and a back electrode with the recording sheet passed thereby.

In the electrophotographic apparatus or the like as noted above, residual toner (hereinafter referred to as waste toner) remaining attached to the photosensitive drum or the like after the toner image transfer, is scraped off with a cleaning blade to be led by conveying means to a toner recovery vessel disposed on the side of a photosensitive drum shaft end or the like.

Also, in the direct toner image recording system noted above, waste toner that remains attached to the mesh electrode is removed electrostatically, hydraulically or with mechanical cleaning means to be led to a toner recovery vessel.

The toner recovery vessel has to be replaced whenever it becomes full of toner. However, usually the timing of toner recovery vessel replacement is not shown on any display or the like. Therefore, it is possible that printing is continued without knowing that the toner recovery vessel has become full of toner, thus resulting in overflow of toner and contamination of the machine inside.

To overcome such drawback, it may be thought to increase the volume of the toner recovery vessel. However, disposing a large volume toner recovery vessel in a limited locality inside the machine leads to corresponding increased restriction on the machine design and is therefore undesired in view of the size reduction of the apparatus.

Accordingly, there have been proposed various developing devices, which include a toner recovery vessel integral with a toner cartridge for replenishing with toner (a toner cartridge with a toner recovery vessel provided thereto being frequently called toner container) so that the toner recovery vessel can be replaced automatically whenever the toner cartridge is replaced.

For example, Japanese Patent Laid-Open Publication No. 33168/1990 shows a technique concerning the pertaining type of toner container, in which a toner cartridge having a cylindrical shape is partitioned by a partitioning wall such as to form a waste toner recovery section adjacent a longitudinal end of a replenishment toner accommodating section via the partitioning wall.

In this technique, however, since the toner container is divided into two sections, i.e., the replenishment toner accommodating section and waste toner recovery section, if it is desired to provide a volume ratio that waste toner can be recovered in the recovery section without overflow in case when toner attached to the photosensitive drum for development is transferred only very slightly and is thus mostly recovered as waste toner, the volume of the replenishment toner accommodating section is inevitably reduced, thus dictating frequent toner container replacement and maintenance operation.

In a different aspect, in the prior art electrophotographic apparatus which is used with a two-component developer composed of carrier and toner, a toner hopper is coupled via a toner replenishment roller to the top of a developer container accommodating the developer having a predetermined mixture ratio, and a toner concentration sensor is disposed in the developer container for detecting changes in the mixture ratio between the toner and carrier with consumption of toner from the developer container in predetermined electrophotographic developing operation for replenishing the developer container with toner from toner container by controlling the toner replenishment roller according to a detection signal from the sensor. Even in such an apparatus, undesired size increase thereof results when the toner hopper and the toner container are constructed separately.

Accordingly, it may be thought to mount a toner replenishment roller in the toner container, that is, construct a detachable toner hopper having a toner container function, thus attaining the volume increase of the toner container while attaining the size reduction of the overall apparatus.

Even with such a structure, however, since in the two-component developer system a toner hopper is disposed on top of the developer container accommodating the developer, an aim of constructing a toner container, in which the replenishment toner accommodating section and waste toner recovery section have certain large sizes, inevitably leads to a size increase of the overall apparatus.

Meanwhile, a substantially conical toner hopper is used to lead toner to a toner replenishment roller section provided at its bottom. Such a structure, however, is not only bulky in consideration of the toner accommodation volume, but also toner agglomeration may easily produced around the toner replenishment roller.

As a further aspect, for preventing the scattering of toner from an opening part of toner replenishment roller when mounting and dismounting the toner hopper (i.e., toner container), it is necessary to mount a shutter member in the opening part. However, unless the shutter member is mounted effectively, the scattering of toner still takes place when mounting or dismounting the toner hopper.

In the apparatus described above, when the toner in the toner container is used up, a new toner cartridge is mounted on the shutter member provided in toner container top opening, then toner is supplied to the toner container by opening the shutter member in an interlocked relation to or independently of opening an opening of the toner cartridge, and then the shutter member is closed before removing the empty toner cartridge.

In this prior art technique, however, since the toner replenishment operation is carried out by mounting the toner cartridge on the toner container, the necessary toner replenishment space is undesirably high.

The toner cartridge usually has an opening which is provided on its underside and held closed by a tape seal or a shutter member, and toner replenishment is made by peeling off the tape seal or causing opening and closing operations of the shutter member. However, in the case of using the tape seal. Toner is scattered from the separated tape. In the case of using the shutter member, the opening and closing operations have to be caused in an interlocked relation to the toner container side shutter member, thus leading to structure complications.

To overcome the above drawbacks, there have been attempts to provide the toner container itself with a cartridge function.

However, at the bottom of the toner container a toner replenishment roller with a sponge cover is provided. Therefore, when mounting and dismounting the toner container, toner may be scattered from the toner replenishment roller section.

To obviate this deficiency, the tape seal or shutter member as noted above may be provided at an outlet opening of the toner replenishment roller section. Even so doing, however, leads again to the complication of the structure and, in vain, to the toner scattering.

The same drawbacks are encountered with apparatus, in which a toner replenishment roller is provided on the developer container side. Particularly, when the toner feed roller in the developer container is taken out after use, toner may be collected on the roller, thus causing contamination of the inside of the machine.

SUMMARY OF THE INVENTION

An object of the invention, in view of the above technical problems, is to provide a suitable layout structure of toner container, which has an integral toner recovery section for recovering waste toner after image formation.

Another object of the invention is to provide a suitable layout structure of developing device, which is combined with the toner container noted above and particularly has a developer container accommodating a developer composed of a plurality of components.

A further object of the invention is to provide a developing device and a toner container therefor, in which the toner container can be mounted and dismounted with respect to the developer container side easily, stably and without contamination with toner or complication of the structure even in case with the toner container itself provided with a cartridge function.

A first aspect of the invention is applicable particularly to a toner container used with a developing device composed of a plurality of components, which comprises a replenishment toner accommodating section, a waste toner recovery section formed adjacent a longitudinal end of the replenishment toner accommodating section via a partitioning wall, and a toner replenishment roller disposed such as to face a toner inlet of a developer container, and in which the volume ratio between the replenishment toner accommodating section and the waste toner recovery section is set such that no overflow of waste toner occurs even when toner used for development on a photosensitive drum is transferred only in a very small amount and is mostly recovered as waste toner (hereinafter referred to as first feature of the invention).

Preferably, in addition to the above first feature, a toner accommodation space is formed by an inclined wall extending with a downward slope from a toner replenishment roller mounting portion of the replenishment toner accommodating section such that replenishment toner in the toner accommodation space is capable of being pulled up to the toner replenishment roller mounting portion with the rotation of a toner agitating fin (hereinafter referred to as second embodiment of the invention).

In this case, preferably the inner surface of the inclined wall defining the toner accommodation space is formed with a raised portion for providing elastic force to the toner agitating fin such that replenishment toner can be pulled upward by the elastic force provided by the raised portion.

Further, along with the first feature noted above, it is suitable to form a toner accommodation space with an inclined wall extending with a downward slope from a toner replenishment roller mounting portion of the replenishment toner accommodating section such that the bottom of the toner accommodation space is found below a toner inlet of the developer container (hereinafter referred to as third feature of the invention).

In this case, preferably the inclined wall has depending positioning pins to be inserted into positioning holes provided on the side of the developer container.

Further, along with the first feature, the replenishment toner accommodating section having a toner replenishment roller mounting portion concentric with the toner replenishment roller and having an arcuate sectional profile to define an arcuate clearance between the toner replenishment roller mounting portion and the toner replenishment roller, a shutter being disposed in the arcuate clearance such as to open and close an opening of the toner replenishment roller mounting portion by rotating by a predetermined angle in an interlocked relation to an operation of mounting or dismounting the toner container (hereinafter referred to as fourth feature of the invention).

With the first feature of the invention, no overflow of waste toner occurs in any case until the reaching of a toner container replacement timing. In addition, the waste toner recovery section is never erroneously left alone since it is integral with the toner container.

Further, since the three components, i.e., the toner hopper, toner cartridge and waste toner recovery section, are made integral, the structure is extremely simplified.

Further, with the second feature of the invention, the toner replenishment roller mounting portion of the replenishment toner accommodating section can be formed not at the bottom but in a middle or upper portion of the toner container. In addition, even when the mounting portion is formed in a middle or upper portion of the toner container, the toner accommodation space can be formed such that it extends with a downward slope from the toner replenishment roller mounting portion. Consequently, it is possible to form a sufficient toner accommodation space even when the height of the toner container is reduced.

Further, according to the invention it is not that toner found at the bottom of the toner accommodation space is fed to the toner replenishment roller, but only replenishment toner having been agitated by the toner agitating fin is fed to the toner replenishment roller mounting portion. In other words, even when toner is held in the toner accommodation space for long time, no agglomerated toner is supplied to the toner replenishment roller side, and thus it is possible to ensure accurate toner concentration control.

Further, with the third feature of the invention, since the bottom of the toner accommodation space extending with a downward slope from the toner replenishment roller mounting portion of the replenishment toner accommodating section is found below a toner inlet of the developer container, it is possible that the developer container and the toner container are level in height and, consequently, it is possible to greatly reduce the height of the overall device.

Further, by the provision of the inclined wall with the depending positioning pins to be inserted in the developer container side positioning holes, the toner container can be readily positioned. Besides, since the positioning is made in the neighborhood of the toner replenishment roller, it is possible to accurately align the developer container side toner inlet and the toner replenishment roller side toner feed port to each other, and thus there is no possibility of contamination with toner.

Further, if one side of the toner container is an inclined wall, tumbling occurs. However, since the toner container has the positioning pins as noted above, it can be installed at a desired position without possibility of tumbling.

Further, with the fourth feature of the invention, since the shutter is disposed by making effective use of an arcuate clearance defined between the toner replenishment roller mounting portion and the toner replenishment roller, that is, since the shutter is disposed in close contact with the outer periphery of the toner replenishment roller, no toner remains in that portion.

Further, since the opening and closing operations of the shutter are done in an interlocked relation to the operations of mounting and dismounting the toner container, there is no possibility that the toner container is removed with the opening of the toner replenishment roller mounting portion held open.

Thus, there is no possibility of contamination with toner when mounting and dismounting the toner container.

A second aspect of the invention is applied to a developing device, which has a toner container as toner replenishment cartridge with a toner replenishment roller controlled for rotation according to a detection signal from a toner concentration sensor.

Particularly, the toner container features a shutter, which is provided for rotation along the outer periphery of the toner replenishment roller to open and close the opening at predetermined angular positions.

Further, the shutter has at least one opening end in frictional contact with the outer periphery of the toner replenishment roller.

In this case, preferably a shutter opening end on the downstream side in the direction of rotation of the toner replenishment roller is pressed against the roller periphery.

It is a further feature of the invention that, particularly in combination with the developer container, the shutter is capable of rotation by a predetermined angle between a position to close an opening and a position to open the opening in an interlocked relation to the mounting and dismounting of the toner container on or from the developer container side.

As a specific structure to this end, it is suitable that the shutter has a mounting sleeve loosely fitted on a shaft of the toner replenishment roller and provided with a pinion gear, that a rack is provided on the side of the developer container such as to extend in the direction of mounting and dismounting of the toner container, and that the shutter is rotatable by a predetermined angle between a position to close the opening and a position to open the opening with the rack and the pinion gear in mesh with each other.

According to such second aspect of the invention, since the shutter is disposed along the outer periphery of the toner replenishment roller, that is, since no clearance is formed between the shutter and the outer periphery of the toner replenishment roller, no scattering of toner occurs when opening or closing the shutter or when mounting or dismounting the toner container in an interlocked relation to the opening or closing operation of the shutter. In addition, since the shutter opening end is in frictional contact with the roller periphery, toner having been attached to the roller periphery can be reliably scraped off when opening and closing the shutter.

In this case, with an arrangement that the shutter opening end on the downstream side in the direction of rotation of the toner replenishment roller is pressed against the roller periphery, toner remaining attached to the toner replenishment roller after toner has been supplied to the developer container side with the rotation of the toner replenishment roller at the time of toner replenishing operation, can be reliably scraped off. It is thus possible to improve the accuracy of toner replenishment.

Further, with the arrangement that the shutter opening end on the upstream side in the direction of rotation or the toner replenishment roller is in contact with the roller periphery, it is possible to restrict the amount toner to be replenished with.

Thus, more reliable restriction of the replenishment toner amount is obtainable with an arrangement that both the upstream and downstream ends of the shutter opening are in contact with the roller periphery.

In this case, the toner replenishment roller is suitably a sponge roller with a sponge cover.

Further, with the arrangement that the developer container side is provided with the rack extending in the direction of mounting and dismounting the toner container and that the shutter is rotatable by a predetermined angle between a position to close an opening and a position to open the opening with the rack and the pinion gear in mesh with each other, in an interlocked relation to the operation of mounting the toner container on the developer container, the pinion gear which is provided coaxially with the shutter is meshed with the developer container side rack and rotated from a shutter closing position to a position permitting replenishment of the developer container with toner. Thus, replenishment with toner can be made.

Further, by causing an operation of removing the toner container after toner therein has been used up, the pinion gear is rotated in mesh with the rack, and the shutter is thus rotated and brought back to the initial closing position.

The toner container according to the invention is not limited to that which has the integral waste toner recovery section. That is, it may be separate from the waste toner recovery section and function as toner hopper, or it may function as a replaceable toner cartridge.

DETAILED DESCRIPTION OF THE PREFERRED EMBODIMENT

A Preferred embodiment of the invention will now be described in detail with reference to the drawings. It is to be construed that unless particularly specified, the sizes, materials, shapes and relative dispositions of constituent parts described in connection with the embodiment have no sense of limiting the scope of the invention but are merely exemplary.

Figure 1A:
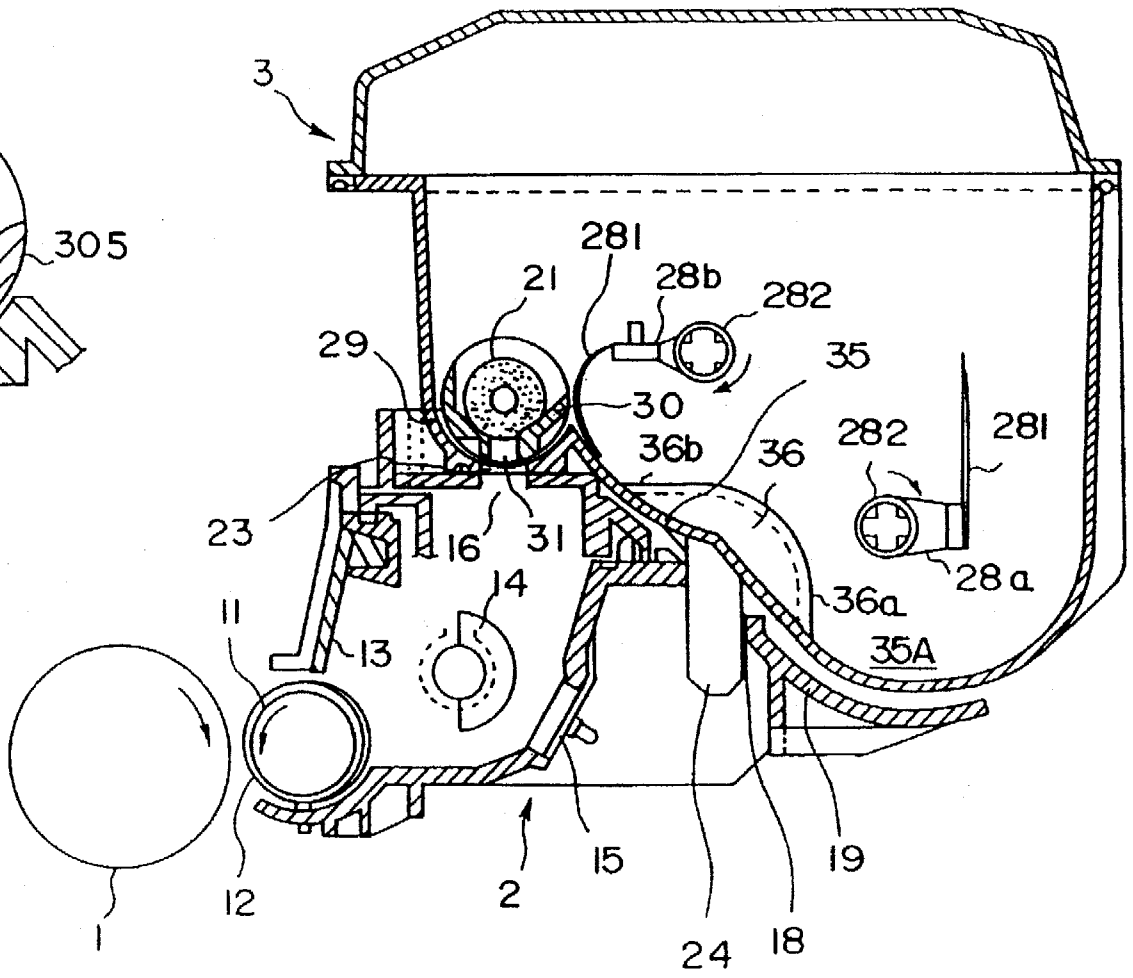
FIGS. 1(A) and 1(B) illustrate a developing device as an embodiment of the invention, FIG. 1(A) being a schematic sectional view, FIG. 1(B) being an enlarged-scale view showing a toner replenishment roller and the periphery thereof.

FIG. 1 schematically shows the structure of developing device in an embodiment of the invention. Reference numeral 1 designates a photosensitive drum, 2 a developer container, and 3 a toner container having a toner hopper function which is capable of being mounted on and dismounted from the developer container 2.

In the developer container 2, a developing sleeve 12 having an inner magnet assembly roller 11 is supported such that it faces the photosensitive drum 1 and can be rotated in the direction shown by arrow. A doctor blade 13 is further provided in the developer container 2 on an upstream wall portion thereof in the direction of rotation of the developing sleeve 12. A mixer 14 for mixing and agitating carrier and toner is further disposed in the developer container 2. A toner concentration sensor 15 is further disposed in the developer container 2 on a lower wall portion thereof facing the mixer 14.

Above the mixer 14, a toner inlet 16 is formed, which is slit-like and has a length substantially equal to the length of a toner replenishment roller 21 provided in the toner container 3.

Figure 3:
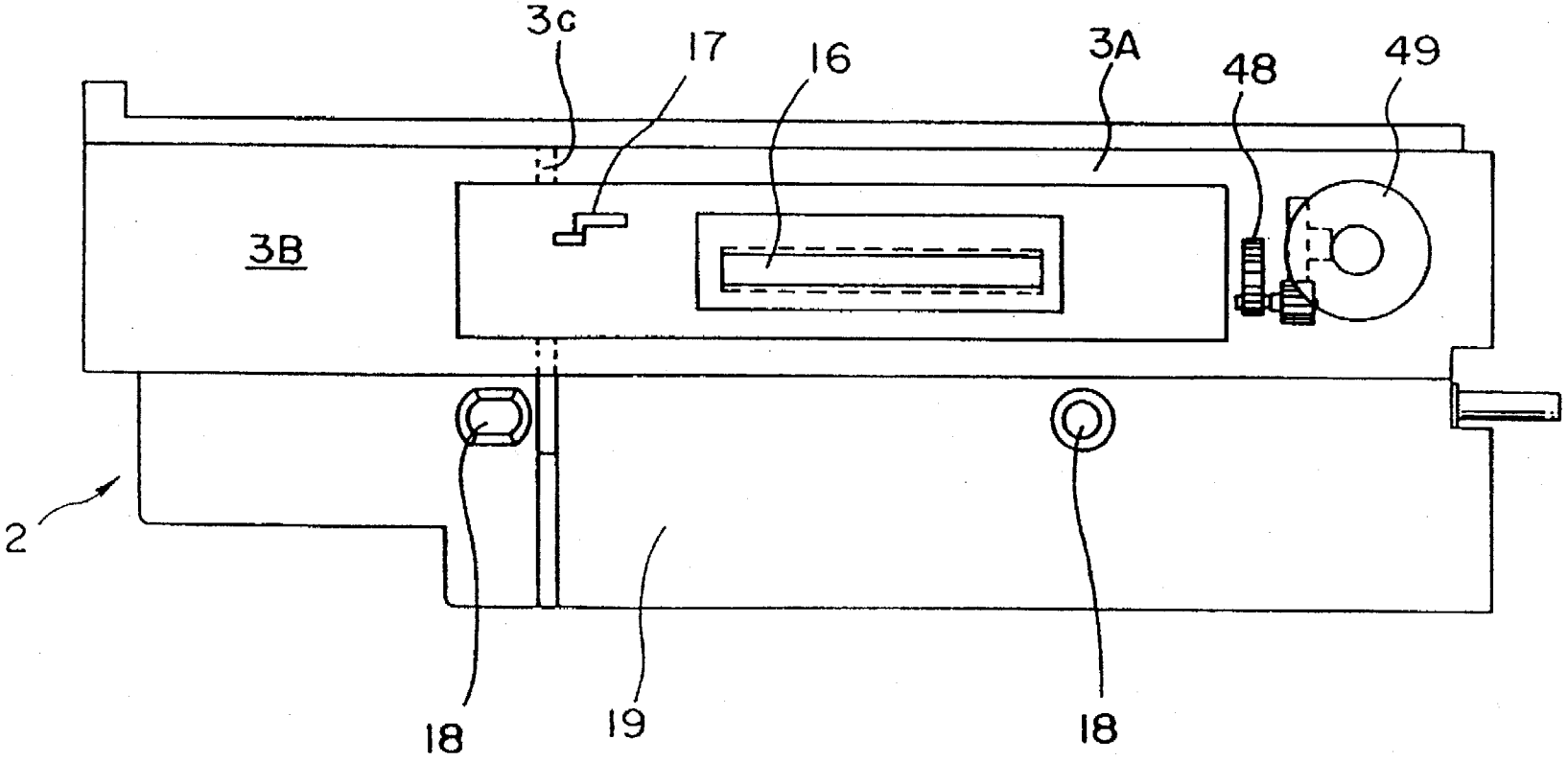
FIG. 3 is a schematic top view showing the developing device shown in FIG. 1.

The toner inlet 16, as shown in FIG. 3, has a length equal to about one-fourth of the length dimension of the developer container 2. A rack 17 is provided on the side of one end of the toner inlet 16 nearer a toner recovery section 3B. On the opposite side, i.e., on the side of the other end of the toner inlet 16, a toner replenishment roller drive motor 49 and a drive gear 48 thereof are provided.

Figure 4A:
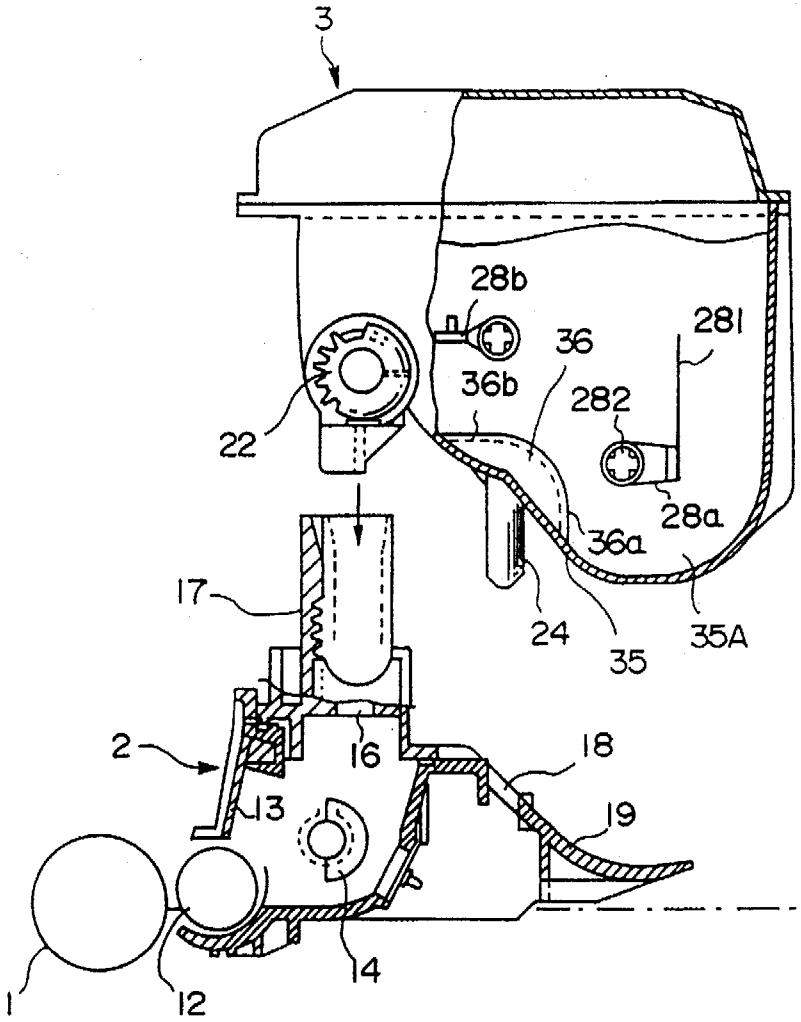
FIGS. 4(A) and 4(B) illustrate a relation of separation between a toner container and a developer container in the developing device, FIG. 4(A) being a sectional view showing a position relation between a rack and a pinion gear, FIG. 4(B) being an enlarged-scale view showing a shutter member in a closing position.

The rack 17 is shown in detail in FIG. 4(A). In an interlocked relation to the operation of mounting and dismounting the toner hopper 3, a pinion gear 22 provided in the hopper 3 is meshed with the rack 17, whereby a shutter member 30 provided in the hopper 3 is rotated by a predetermined angle from its position closing a toner feed port 23 to its position with its opening 31 aligned to the toner feed port.

The developer container 2 has its back formed with a hopper mounting section 19, which is gently inclined downward from the toner inlet 16. The hopper mounting section 19 has its intermediate portion formed with a pair of positioning holes 18. The hopper 3 has a pair of positioning pins 24 which can be inserted into the positioning holes 18, whereby the hopper 3 is positioned.

Figure 2:
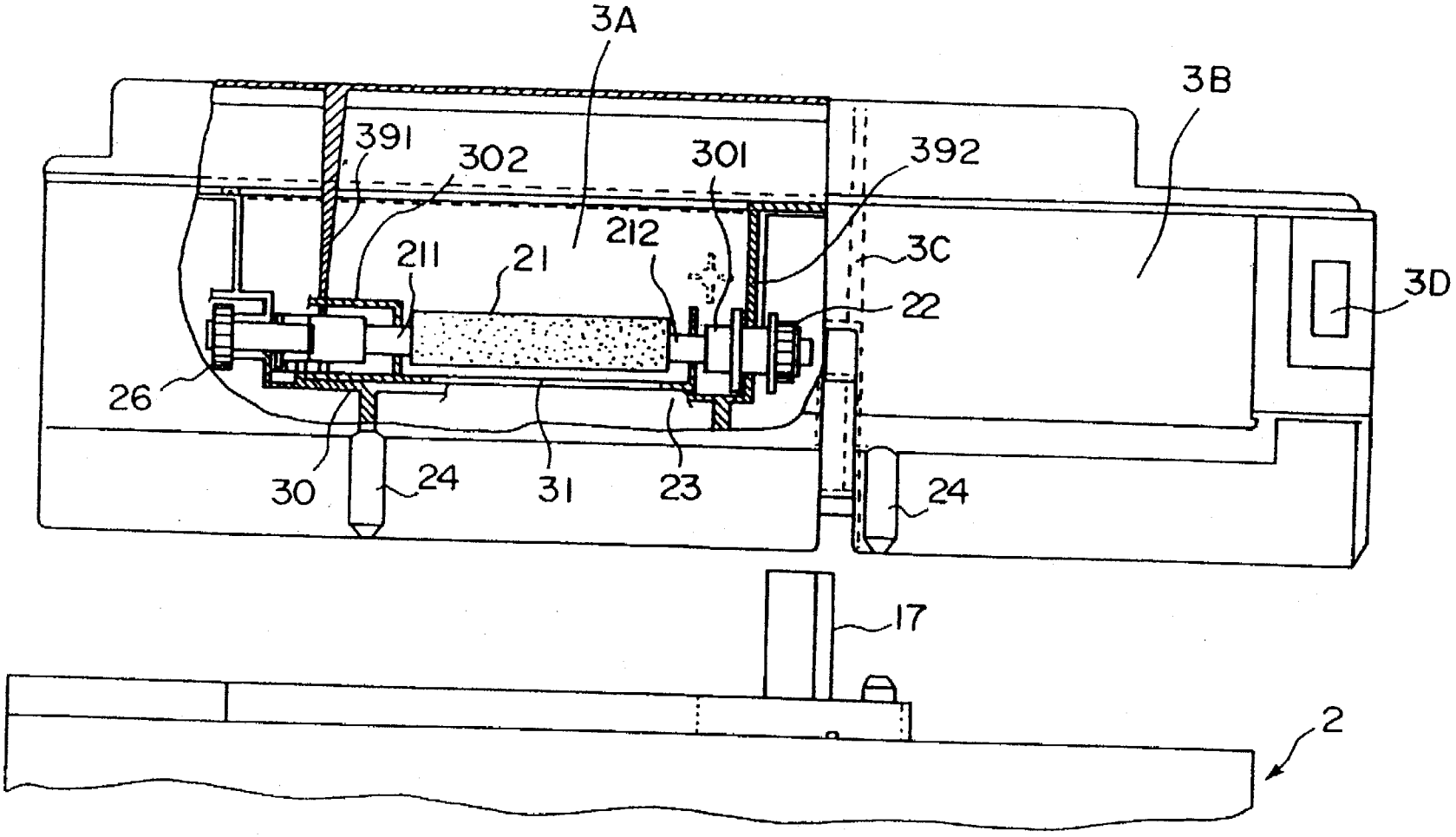
FIG. 2 is a longitudinal schematic view showing the developing device shown in FIG. 1.

Referring to FIG. 2, the toner container 3 has a replenishment toner accommodating section 3A and a waste toner recovery section 3B, these sections 3A and 3B being integral with each other and defined by a partitioning wall 3C, the replenishment toner accommodating section 3A being defined substantially in its longitudinally central portion, the waste toner recovery section 3B being defined adjacent one of its longitudinal ends. The top wall of the waste toner recovery section 3B is provided adjacent the end of the toner container 3 with a waste toner recovery port 3D, through which waste toner can be recovered by waste toner recovery mechanism (not shown) provided in the device body.

The waste toner recovery port 3D may be manually closed with a lid when mounting and dismounting the toner container. Alternatively, a lid structure may be provided, which can automatically close the waste toner recovery port 3D at the time of mounting and dismounting operations of the waste toner recovery mechanism. Such a structure may be provided by utilizing, for instance, a technique disclosed in Japanese Patent Application No. 186182/1992.

The waste toner recovery section 3B is of a volume ratio which is set such that all waste toner can be recovered in it even in case when replenishment toner is used only in a very small amount and mostly deemed to be waste toner.

The replenishment toner accommodating section 3A, as shown in FIG. 1, has a recessed portion 29 having an arcuate sectional profile and constituting the bottom of the hopper 3. The slit-like toner feed port 23 is formed in the recessed portion 29. Shutter member 30 and toner replenishment member 21 are provided coaxially such that they face the port 23.

The toner container 3, as shown in FIG. 1, has an inclined wall 35 which extends downward from the end of the arcuate profile of the recessed portion 29 along the hopper mounting section 19, the inclined wall 35 having the pair positioning pins 24 extend downward such as to correspond to the positioning holes 18.

The positioning pins 24 depend from positions which substantially tri-sect the length of the toner container 3, and their lower end is substantially in level with the lowermost portion of the bottom of the toner container 3.

The inclined wall 35 defines a toner accommodation space 35A.

Generally, the bottom of the toner container 3 is found below the toner inlet 16 of the developer container 2. Consequently, the developer container 2 is disposed in a substantially triangular front space defined by the inclined wall 35 of the toner container 3, thus providing for substantial height reduction of the device and reduction of ineffective space.

Toner agitating fins 28*a* and 28*b* are disposed in the toner container 3. They each have a fin section 281 having elasticity and a shaft section 282 supporting the fin section 281. They are driven in an interlocked relation to the rotation of the toner replenishment roller 21 via a gear train (not shown).

The toner agitating fins 28*a* and 28*b* are disposed at a lower position and at an upper position along the inclined wall 35. The inner surface of the inclined wall 35 is formed with a staircase-like raised portion 36 such as to face the fins 28*a* and 28*b*.

The raised portion 36 has a vertical surface 36*a* which is found within the radius of rotation of the downstream side toner agitating fin 28*a*.

The toner replenishment roller and peripheral structure will now be described with reference to FIGS. 2 and 1(B).

The toner replenishment roller 21 is enclosed by a sponge cover, and it has opposite end shafts 211 and 212. The end shaft 211 penetrates a hopper support wall, and its projecting end portion has a driven gear 26 secured thereto. The driven gear 26 is meshed with a device body side drive system when the hopper 3 is mounted. The other end shaft 212 is rotatably inserted in a crown-like sleeve 301 of the shutter member 30.

The toner replenishment roller 21 thus can be rotated independently of the shutter member 30.

The shutter member 30 has a substantially arcuate sectional profile. Its longitudinally central portion has an opening or slit 31 corresponding to the toner feed port 23. It further has opposite end sleeves 301 and 302 having a cylindrical and crown shape, respectively. The end shafts of the toner replenishment roller 21 are rotatably supported in the end sleeves 301 and 302.

The end sleeves 391 and 392 are rotatably supported in support walls 301 and 302 of the hopper 3. The end sleeve 301 of the toner replenishment roller 21 on the side opposite the mounting position of the driven gear 26, which penetrates the support wall 391 of the hopper, has a projecting portion provided with pinion gear 22 secured thereto for meshing with rack 17.

As shown in FIG. 4(A), the pinion gear 22 which is meshed with the rack 17, has a tooth face formed only in an angle range of swinging of the shutter opening 31 from the position, at which the toner feed port 23 is closed, to the position to open the toner feed port or vice versa.

Figure 1B:
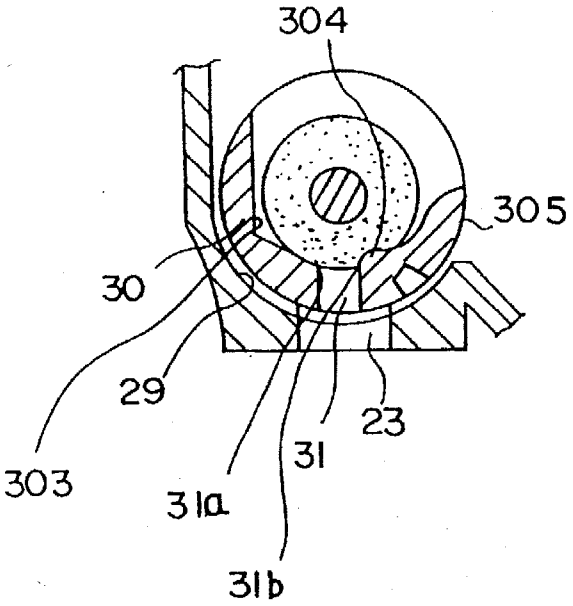

As shown in FIG. 1(B), the inner periphery 303 of the shutter member 30 on the left side of the opening 31, i.e., on the upstream side thereof in the direction of rotation of the toner replenishment roller 21, is formed such that it becomes gradually narrower with the rotation of the toner replenishment roller 21, and its end 31*a* at the opening 31 is substantially in contact with the toner replenishment roller 21.

The inner periphery of the shutter member 30 on the right side of the opening 31, i.e., on the downstream side thereof in the direction of rotation of the toner replenishment roller 21, is formed with a protuberance 304 which wedges in the outer periphery of the toner replenishment roller 21 at the end 31*b* of the opening 31.

The shutter member 30 has its outer periphery 305 formed along and defining a clearance with the inner periphery of the recessed portion 29 of the hopper bottom such that it is rotatable but as less toner as possible enters the clearance.

Figure 4B:
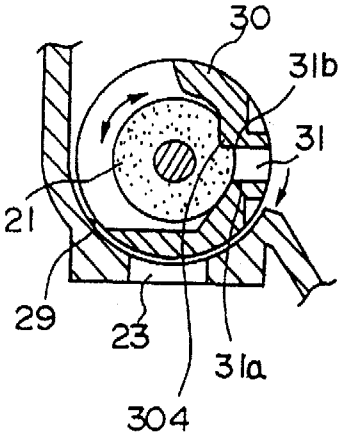

The procedure of mounting and dismounting the hopper 3 in this embodiment will now be described with reference to FIGS. 1(A), 1(B), 4(A) and 4(B). When the hopper 3 is alone and not mounted, as shown in FIG. 4(B), the opening 31 of the shutter member 30 is directed side-wise, and the toner feed port 23 of the hopper 3 is closed.

When the hopper 3 is mounted on the side of the developer container 2, as shown in FIG. 4(A), by lowering it with its positioning pins 24 fitted in the positioning holes 18 for positioning, the pinion gear 22 is first meshed with the rack 17.

The rack 17 has a number of teeth and a tooth angle necessary for the rotation of the pinion gear 22 by about 90 degrees. Thus, in mesh with the rack 17, the pinion gear 22 is rotated clockwise by about 90 degrees, thus bringing the shutter opening 31 into a lower position in alignment with the toner feed port 23 as shown in FIG. 1(B).

When the toner container is mounted regularly in the predetermined position noted above, the driven gear 26 of the toner replenishment roller 21 is meshed with the device body side drive system.

When a developing operation is carried out in this state, the toner concentration sensor 15 detects changes in the mixture ratio between toner and carrier as toner is consumed from the developer container 2 via the developing sleeve 12 in a predetermined electrophotographic developing operation, and the developer container 2 is replenished with toner from the toner container 3 through control of the toner replenishment roller 21 according to a detection signal from the sensor 15.

At this time, the toner agitating fins 28*a* and 28*b* in the toner container are driven in an interlocked relation to the rotation of the toner replenishment roller 21. As the lower toner agitating fin 28*a* is driven in frictional contact with the bottom of the toner accommodation space 35A, it is pressed against the vertical surface 36*a* of the raised portion 36 to be given elastic force. By the elastic force thus provided, replenishment toner is pulled upward onto the top surface 36*b* of the raised portion 36.

The upper toner agitating fin 28*b* is brought to be in frictional contact with the top surface 36*b* of the raised portion 36, and the toner having been brought onto the top surface 36*b* is pulled upward into the recessed portion 29 in which the toner replenishment roller is provided.

Thus, with this embodiment even replenishment toner which is found at the bottom of the toner accommodation space can be fed to the side of the developer container by the toner replenishment roller after being agitated in two stages by the lower and upper toner agitating fins 28*a* and 28*b*.

In this case, since the toner replenishment roller 21 is rotated counterclockwise, the shutter member 30, with its opening 31 on the upstream side, has its inner periphery gradually becoming narrower with the rotation of the toner replenishment roller 21, and its opening end 31*a* is substantially in contact with the toner replenishment roller 21, thus restricting the amount of replenishment toner.

Further, after toner has been supplied through the opening 31, the toner remaining attached to the toner replenishment roller 21 is scraped toward the opening 31 by the protuberance 304 at the downstream side opening end 31*b*. The scraped toner is allowed to fall into the developer container 2.

The above operation is repeated.

When the replenishment toner in the toner container or hopper 3 has been used up, the hopper 3 is removed. At this time, since the pinion gear 22 is in mesh with the rack 17, it is rotated counterclockwise by about 90 degrees in an interlocked relation to the operation of removing the hopper 3, thus causing rotation of the shutter opening 31 by 90 degrees from the downward position to the side-wise position to close the toner feed port.

At this time, since the shutter opening ends 31*a* and 31*b* are in contact with the outer periphery of the toner replenishment roller 21, the shutter member is rotated to the closing position while scraping toner off the outer periphery of the toner replenishment roller 21.

Thus, there is no possibility of erroneous scattering of toner when removing the toner container.

Further, when the hopper 3 is mounted again after charging toner again thereinto, toner on the outer periphery of the toner replenishment roller 21 is scraped off. Thus, again there is no possibility of scattering of toner.

As has been described in detail in the foregoing, in the above embodiment no overflow of waste toner occurs in any case until reaching of a toner container replacement timing. In addition, the waste toner recovery section is never erroneously left alone since it is integral with the toner container.

Further, since the three components, i.e., the toner hopper, toner cartridge and waste toner recovery section, are integral, the structure can be extremely simplified.

Further, even when the height of the toner container is reduced, a sufficient toner accommodation space can be formed, thus permitting size reduction of the device and simplification of maintenance.

Further, with this embodiment, even by increasing the toner accommodation space, that is, when toner is deposited for long time in the toner accommodation space, the deposited toner is not supplied to the toner replenishment roller side, and the toner concentration can be controlled accurately.

Further, since in this embodiment the developer container and toner container can be made level in height, even by increasing the toner accommodation space it is possible to greatly reduce the height of the device as a whole, and it is readily possible to attain size reduction of the device.

Further, in this embodiment the toner container can be simply positioned by the positioning pins. In addition, it is possible to accurately align the toner inlet on the developer container side and the toner feed port on the toner replenishment roller side to each other, and thus there is no possibility of contamination by toner.

Further, the toner container can be installed in a desired position without possibility of tumbling or the like, and ready handling can be attained.

Further, in this embodiment contamination by toner does not occur when mounting and dismounting the toner container.

Further, in this embodiment, in case where the toner container is provided with a function of a cartridge, there is no possibility of contamination by toner or complications of the structure. Besides, the toner container can be mounted on and dismounted from the developer container stably and in simple operations.

Further, in this embodiment the toner replenishment may be made accurately and stably, and the toner container can be removed without leaving toner on the developer container, thus eliminating the contamination of the inside of the device due to dropping of toner.

What is claimed is:

1. A toner container comprising a replenishment toner accommodating section, a waste toner recovery section formed adjacent a longitudinal end of the replenishment toner accommodating section via a partitioning wall, and a toner replenishment roller disposed such as to face a toner inlet of a developer container, the volume ratio between the replenishment toner accommodating section and the waste toner recovery section being set such that no overflow of waste toner occurs even when toner used for development on a photosensitive drum is transferred only in a very small amount and is mostly recovered as waste toner, the volume ratio being not less than about 1:1, a toner accommodation space being formed by an inclined wall extending with a downward slope from a toner replenishment roller mounting portion of the replenishment toner accommodating section, replenishment toner in the toner accommodation space being capable of being pulled up to the toner replenishment roller mounting portion with the rotation of a toner agitating fin.

2. A toner container comprising a replenishment toner accommodating section, a waste toner recovery section formed adjacent a longitudinal end of the replenishment toner accommodating section via a partitioning wall, and a toner replenishment roller disposed such as to face a toner inlet of a developer container, the volume ratio between the replenishment toner accommodating section and the waste toner recovery section being set such that no overflow of waste toner occurs even when toner used for development on a photosensitive drum is transferred only in a very small amount and is mostly recovered as waste toner, a toner accommodation space being formed by an inclined wall extending with a downward slope from a toner replenishment roller mounting portion of the replenishment toner accommodating section, replenishment toner in the toner accommodation space being capable of being pulled up to the toner replenishment roller mounting portion with the rotation of a toner agitating fin, wherein the inner surface of the inclined wall defining the toner accommodation space has a raised portion means for providing an elastic force to the toner agitating fin and for enabling the toner agitating fin to upwardly pull replenishment toner in the toner accommodation space by the elastic force provided by the raised portion means.

3. A toner container comprising a replenishment toner accommodating section, a waste toner recovery section forme: adjacent a longitudinal end of the replenishment toner accommodating section via a partitioning wall, and a toner replenishment roller disposed such as to face a toner inlet of a developer container, the volume ratio between the replenishment toner accommodating section and the waste toner recovery section being set such that no overflow of waste toner occurs even when toner used for development on a photosensitive drum is transferred only in a very small amount and is mostly recovered as waste toner, the volume ratio being not less than about 1:1, a toner accommodation space being formed by an inclined wall extending with a downward slope from a toner replenishment roller mounting portion of the replenishment toner accommodating section, the toner bottom of the accommodation space disposed below the toner inlet of the developer container.

4. The toner container according to claim 3, wherein the inclined wall has depending positioning pins to be inserted in developer container side positioning holes.

5. A toner container comprising a replenishment toner accommodating section, a waste toner recovery section formed adjacent a longitudinal end of the replenishment toner accommodating section via a partitioning wall, and a toner replenishment roller disposed such as to face a toner inlet of a developer container, the volume ratio between the replenishment toner accommodating section and the waste toner recovery section being set such that no overflow of waste toner occurs even when toner used for development on a photosensitive drum is transferred only in a very small amount and is mostly recovered as waste toner, the volume ratio being not less than about 1:1, the replenishment toner accommodating section having a toner replenishment roller mounting portion concentric with the toner replenishment roller and having an arcuate sectional profile to define an arcuate clearance between the toner replenishment roller mounting portion and the toner replenishment roller, a shutter being disposed in the arcuate clearance such as to open and close an opening of the toner replenishment roller mounting portion by rotating by a predetermined angle in an interlocked relation to an operation of mounting or dismounting the toner container.

6. A toner container functioning as toner hopper having an opening facing a developer container accommodating a developer composed of a plurality of components, comprising a toner replenishment roller disposed in the opening and controlled for rotation according to a detection signal from a toner concentration sensor provided on the side of the developer container, a shutter being provided for rotation along the outer periphery of the toner replenishment roller to open and close the opening at predetermined angular positions, the shutter having at least one opening end in frictional contact with the outer periphery of the toner replenishment roller, toner having been attached to the toner replenishment roller being capable of being scraped off with the rotation thereof.

7. A developing device with a toner container capable of being mounted and dismounted, functioning as toner hopper and having an opening facing a developer container accommodating a developer composed of a plurality of components, comprising a toner replenishment roller disposed in the opening and controlled for rotation according to a detection signal from a toner concentration sensor provided on the side of the developer container, a shutter being provided for rotation along the outer periphery of the toner replenishment roller to open and close the opening at predetermined angular position, the shutter having at least one opening end in frictional contact with the outer periphery of the toner replenishment roller, the shutter being capable of being rotated by a predetermined angle between a position to close the opening and a position to open the opening in an interlocked relation to operations of mounting and dismounting the toner container on and out of the developer container.

8. The developing device according to claim 7, wherein the shutter has a mounting sleeve loosely fitted on a shaft of the toner replenishment roller and provided with a pinion gear, a rack is provided on the side of the developer container such as to extend in the direction of mounting and dismounting of the toner container, and the shutter is rotatable by a predetermined angle between a position to close the opening and a position to open the opening with the rack and the pinion gear in mesh with each other.

9. The developing device according to claim 7, wherein the end of the shutter opening located on the downstream side in the direction of rotation of the toner replenishment roller is pressed against the outer periphery thereof such as to be able to be welded.

* * * * *